US005092297A

United States Patent [19]

Tsukamoto et al.

[11] Patent Number: 5,092,297

[45] Date of Patent: Mar. 3, 1992

[54] AIR-FUEL RATIO CONTROL DEVICE FOR A VEHICLE ENGINE

[75] Inventors: Keisuke Tsukamoto; Toshio Takaoka; Takao Fukuma; Hirofumi Yamasaki, all of Toyota, Japan

[73] Assignee: Toyota Jidosha Kabushiki Kaisha, Toyota, Japan

[21] Appl. No.: 646,663

[22] Filed: Jan. 28, 1991

[30] Foreign Application Priority Data

Jan. 31, 1990 [JP] Japan ..... 2-18971

[51] Int. Cl.[5] ..... F02M 51/00

[52] U.S. Cl. ..... 123/491

[58] Field of Search ..... 123/491, 179 L, 179 G, 123/179 C

[56] References Cited

U.S. PATENT DOCUMENTS 4,644,921 2/1987 Kobayashi et al. ..... 123/489
4,765,301 8/1988 Koike et al. ..... 123/491
4,773,378 9/1988 Fujimura et al. ..... 123/491

FOREIGN PATENT DOCUMENTS 58-48727 3/1983 Japan .
59-162329 9/1984 Japan .
59-170431 9/1984 Japan .
59-196932 11/1984 Japan .
60-211651 10/1985 Japan .
63-9649 1/1988 Japan .

*Primary Examiner*—Raymond A. Nelli
*Attorney, Agent, or Firm*—Kenyon & Kenyon

[57] ABSTRACT

An air-fuel ratio control device for an vehicle engine, by which the air-fuel ratio of the air-fuel mixture supplied to a vehicle engine is changed. The device sets the air-fuel ratio to a lean mixture when the engine coolant temperature is higher than a predetermined value and the vehicle speed is higher than a value determined by a time elapsed after engine startup.

28 Claims, 5 Drawing Sheets

AIR-FUEL RATIO CONTROL DEVICE FOR A VEHICLE ENGINE

BACKGROUND OF THE INVENTION

1. Field of the Invention

The present invention relates to an air-fuel ratio control device for a vehicle engine which is operated mainly on a lean air-fuel mixture.

2. Description of the Related Art

Engines which are operated on a lean air-fuel mixture having an air-fuel ratio higher than a stoichiometric ratio in the main operating range of the engines are known as lean burn engines. Usually, the lean burn engines are operated on a lean air-fuel mixture, and when acceleration or high load operations are required, the air-fuel ratio of the mixture on which the engine is operated is switched to the stoichiometric ratio or lower (rich) ratio, so that a high engine performance can be obtained without a worsening of the exhaust emissions and fuel efficiency.

When an engine is not sufficiently warmed up, it is difficult to obtain a stable combustion in the cylinders on a lean air-fuel mixture. Therefore, usually a lean-burn engine is operated on a stoichiometric air-fuel mixture during warming up, and the air-fuel ratio is switched to the lean condition after the engine is fully warmed up. The timing at which the air-fuel ratio is switched to the lean mixture ratio, i.e., the completion of the engine warm up, is usually determined by detecting the temperature of the engine coolant, such as cooling water.

For example, Japanese Unexamined Patent Publication No. 58-48727 discloses an engine operated on a stoichiometric air-fuel ratio mixture when the temperature of the engine cooling water is lower than the predetermined value, and when the temperature of the cooling water reaches the predetermined value, the air-fuel ratio is switched to lean ratio.

Nevertheless, the actual factor which influences the condition of the combustion in the cylinders is the wall temperature of the combustion chamber, not the cooling water temperature, and therefore, if the air-fuel ratio of the mixture is determined by the cooling water temperature only, in some cases a stable combustion cannot be obtained. For example, if the engine is stopped after being fully warmed up, and then restarted within a relatively short time, sometimes the combustion becomes unstable and misfires occur. This is caused by the difference in the cooling speeds of the cooling water and the wall of the combustion chamber. Namely, due to a high specific heat, the cooling speed of the cooling water is low but the cooling speed of the wall of the combustion chamber is relatively high. Therefore, when the engine is stopped while in a fully warmed up condition, the temperature of the cooling water drops very slowly; in practice, the temperature of the cooling water does not change for several minutes. Therefore, in the prior art, if the engine is re-started after a short stop of several minutes, the air fuel ratio is made lean immediately after the engine start up, since the cooling water temperature is still higher than the predetermined value. Nevertheless, the wall temperature of the combustion chamber drops more rapidly, and even within short stops of several minutes, the wall temperature of the combustion chamber becomes too low for a stable combustion of the lean air-fuel mixture. Consequently, in the prior art, when the engine is re-started after a short stop, an unstable combustion or misfire sometimes occurs due to an inappropriate switching to the lean mixture.

To solve this problem, the switching of air-fuel ratio of air-fuel mixture fed to engine must be controlled in accordance with the wall temperature of the combustion chamber, but a reliable measurement of the wall temperature of the combustion chamber with conventional devices is very difficult, and thus a control in accordance with the wall temperature is not considered practical.

SUMMARY OF THE INVENTION

An object of the present invention is to provide an air-fuel ratio control device which can prevent an inappropriate changeover to a lean air-fuel mixture when the wall temperature of the combustion chamber is low, and thus can prevent the occurrence of misfires and an unstable combustion.

According to the present invention, there is provided an air-fuel ratio control device for a vehicle engine comprising: a means for detecting the engine coolant temperature; an operation mode selecting means for selecting the mode of operation of the engine, this selecting means selecting a rich mixture operation mode in which the engine is operated on a rich mixture having an air-fuel ratio lower than or equal to a stoichiometric ratio when the engine coolant temperature is lower than a predetermined value, and selecting a lean mixture operation mode in which the engine is operated on a lean mixture having an air-fuel ratio higher than a stoichiometric ratio when the engine coolant temperature is higher than the predetermined value; an air-fuel ratio setting means for adjusting the air-fuel ratio of the mixture in accordance with the operation mode selected by the operation mode selecting means; a start detecting means for detecting a start up of the engine; and a prohibiting means for prohibiting a selection by the operation mode selecting means of the lean mixture operation mode during the period from the start up of the engine until the speed of the vehicle reaches a predetermined value.

The present invention will be more fully understood from the description of a preferred embodiment of the invention set forth below, together with the accompanying drawings.

DESCRIPTION OF A PREFERRED EMBODIMENT

Figure 1:
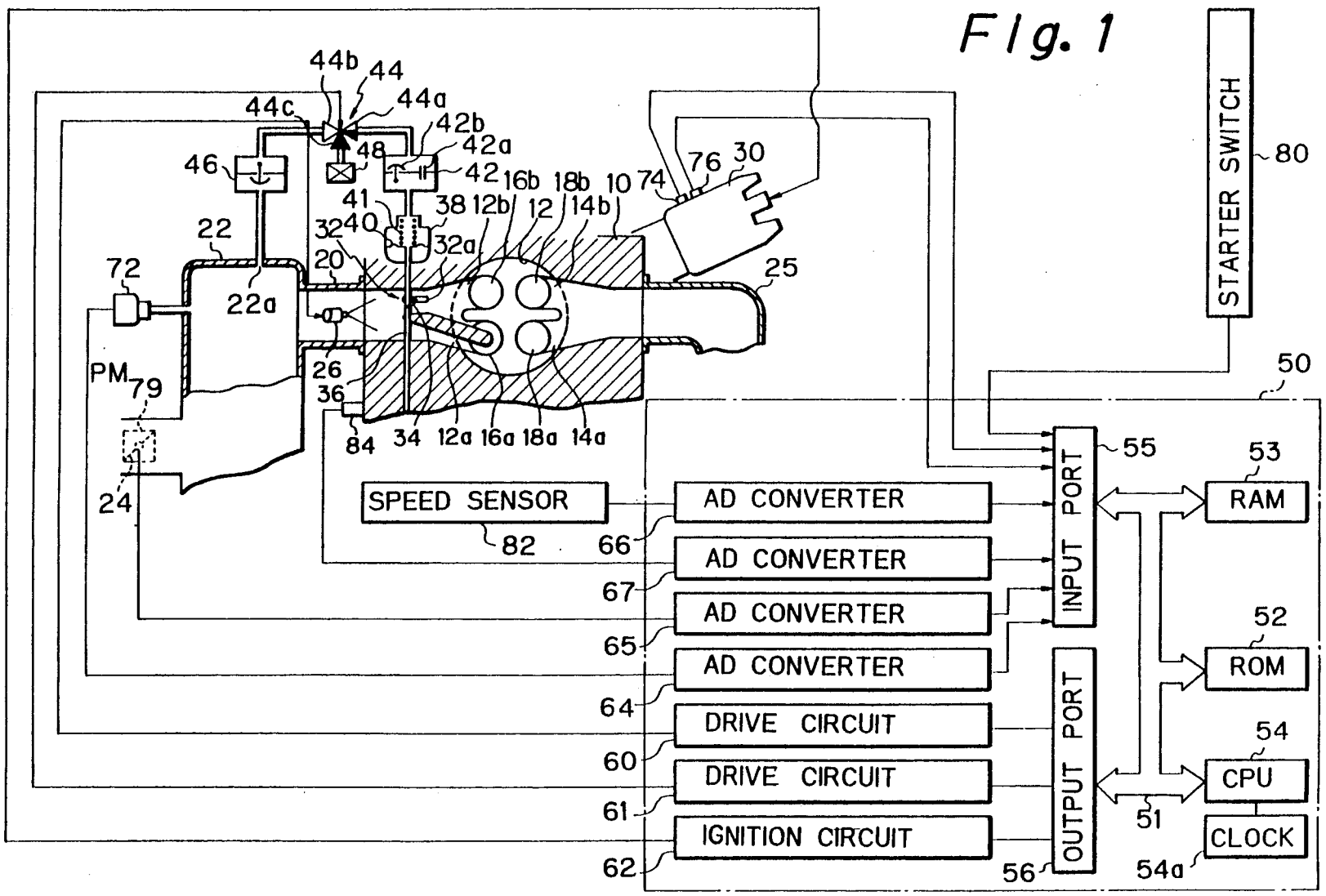
FIG. 1 is a schematically illustrated view of an engine.

FIG. 1 illustrates an embodiment of the air-fuel ratio control device according to the present invention.

Referring to FIG. 1, reference numeral 10 represents a cylinder block of an engine, and 12 is a cylinder bore. As shown in the figure, each cylinder of the engine is provided with two intake ports 12*a*, 12*b* and two exhaust ports 14*a*, 14*b*, and inlet valves 16*a*, 16*b* and exhaust valves 18*a*, 18*b* are provided at the respective ports, 12*a*, 12*b* and 14*a*, 14*b*.

The first inlet port 12*a* is formed as a helical port which deflects the inlet air flow to thereby generate a swirl in the cylinder. The second inlet port 12*b* is formed as a conventional straight type inlet port. The inlet ports 12*a* and 12*b* are connected to a surge tank 22 and a throttle valve 24 via an intake air passage 20, and a fuel injector 26 is mounted on the intake air passage 20 near each cylinder. The exhaust ports 14*a* and 14*b* are connected to an exhaust manifold 28.

Reference numeral 30 represents a distributor which supplies high voltage electricity to spark plugs (not shown) at the respective cylinders.

Each straight type inlet port 12*b* is equipped with a swirl control valve 32 which is in either the open or closed position. When the swirl control valve 32 is in the closed position, the straight port 12*b* is closed and all of the inlet air flows into the engine through the helical port 12*a*. Accordingly, the inlet air flow forms a strong swirl in the engine cylinder, and thus a stable combustion of the lean air-fuel mixture can be obtained. Conversely, when the swirl control valve 32 is in the open position, the inlet air flows into the cylinder through both of the inlet ports 12*a*, 12*b*, whereby the volume of the inlet air is increased.

The swirl control valve 32 comprises a valve plate 32*a* connected to an actuator 38 via a lever 34 and a rod 36.

The actuator 38 comprises a diaphragm 40, and spring 41 biasing the diaphragm downward. When a negative pressure is introduced to the upper side of the diaphragm 40, the diaphragm 40 and the rod 36 are moved upward against the force of the spring 41 and the swirl control valve 32 is moved to the open position. Conversely, when the atmospheric pressure is introduced to the upper side of the diaphragm 40, the swirl control valve 32 is urged downward to the closed position, by the spring 41.

The chamber formed at the upper side of the diaphragm 40 is connected to the pressure port 22*a* formed on the surge tank 22 via a timing control valve 42, a solenoid operated three-way valve 44, and a check valve 46. The timing control valve 42 includes an orifice 42*a* and a check valve 42*b* arranged in parallel to each other. The timing control valve 42 maintains the opening speed of the swirl control valve 32 at an appropriate level by controlling the speed of the introduction of the atmospheric air to the upper side of the diaphragm 40. The check valve 46 maintains the negative pressure on the upper side of the diaphragm 40 when the pressure in the surge tank 22 becomes higher.

The solenoid operated three way valve 44 comprises three ports 44*a*, 44*b* and 44*c*. When the solenoid is de-energized, the port 44*a* is communicated with the port 44*c*, and the upper side of the diaphragm 40 is open to the pressure port 22*a* of the surge tank 22. On the other hand, when the solenoid is energized, the port 44*a* is communicated to the port 44*b*, and the upper side of the diaphragm 40 is open to the atmosphere, through a filter 48 and the orifice 42*a* of the timing control valve 42.

An electronic control unit 50 is provided to control the swirl control valve 32 by energizing and de-energizing the solenoid of the three way valve 44. The electronic control unit 50 is constructed as a digital computer which comprises a ROM (read only memory) 52, a RAM (random access memory) 53, a CPU (central processing unit) 54, an input port 55 and an output port 56. The ROM 52, the RAM 33, the CPU 54, the input port 55 and the output port 56 are interconnected by a bidirectional bus 51.

The electronic control unit 50 also controls the amount of fuel injected by a fuel injector 26 and the ignition timing according to the invention. Accordingly, the output port 56 of the electronic control unit 50 is connected to the fuel injector 26 and the solenoid operated three way valve 44, via a corresponding drive circuit 60 and 61, and to the distributor 30 via a ignition circuit 62. An absolute pressure sensor 72, which generates an output voltage proportional to the absolute pressure PM in the surge tank 22, is mounted on the surge tank 22, and the output voltage of the absolute pressure sensor 72 is input to the input port 55 via an AD convertor 64.

Crank angle sensors 74 and 76 are mounted on the distributor 30. The first crank angle sensor 74 detects a reference position of the crank shaft rotation and generates a pulse signal at, for example, each 720 degrees rotation of the crank shaft. The second crank angle sensor 76 detects the rotation angle of the crank shaft and generates a pulse signal at, for example, each 30 degrees rotation of the crank shaft.

The outputs of the crank angle sensors 74, 76 are input to the input port 55, and the engine speed NE is calculated from the pulse output by the crank angle sensor 76 to the CPU 54.

A throttle sensor 79 is mounted on the throttle valve 24 and generates an output voltage proportional to the degree of opening of the throttle valve 24. The output of the throttle sensor 79 is input to the input port 55 via an AD converter 65. Reference numeral 80 indicates a starter switch which transmits a start signal to the input port 55 when the starting motor (not shown) of the engine is energized. The electronic control unit 50 is provided with a built in clock 54*a*, which generates a clock pulse for the CPU 54. When the startup of the engine is completed, the electronic control unit 50 starts to count the pulses of the clock 54*a*, to thereby measure the time elapsed after startup. A speed sensor 82 generates an output voltage proportional to a speed of the vehicle driven by the engine. A coolant temperature sensor 84, which generates an output voltage proportional to the cooling water temperature, is mounted on the engine. The outputs of the speed sensor 82 and the coolant temperature sensor 84 are input to the input port 55 via corresponding AD converters 66 and 67.

Figure 2:
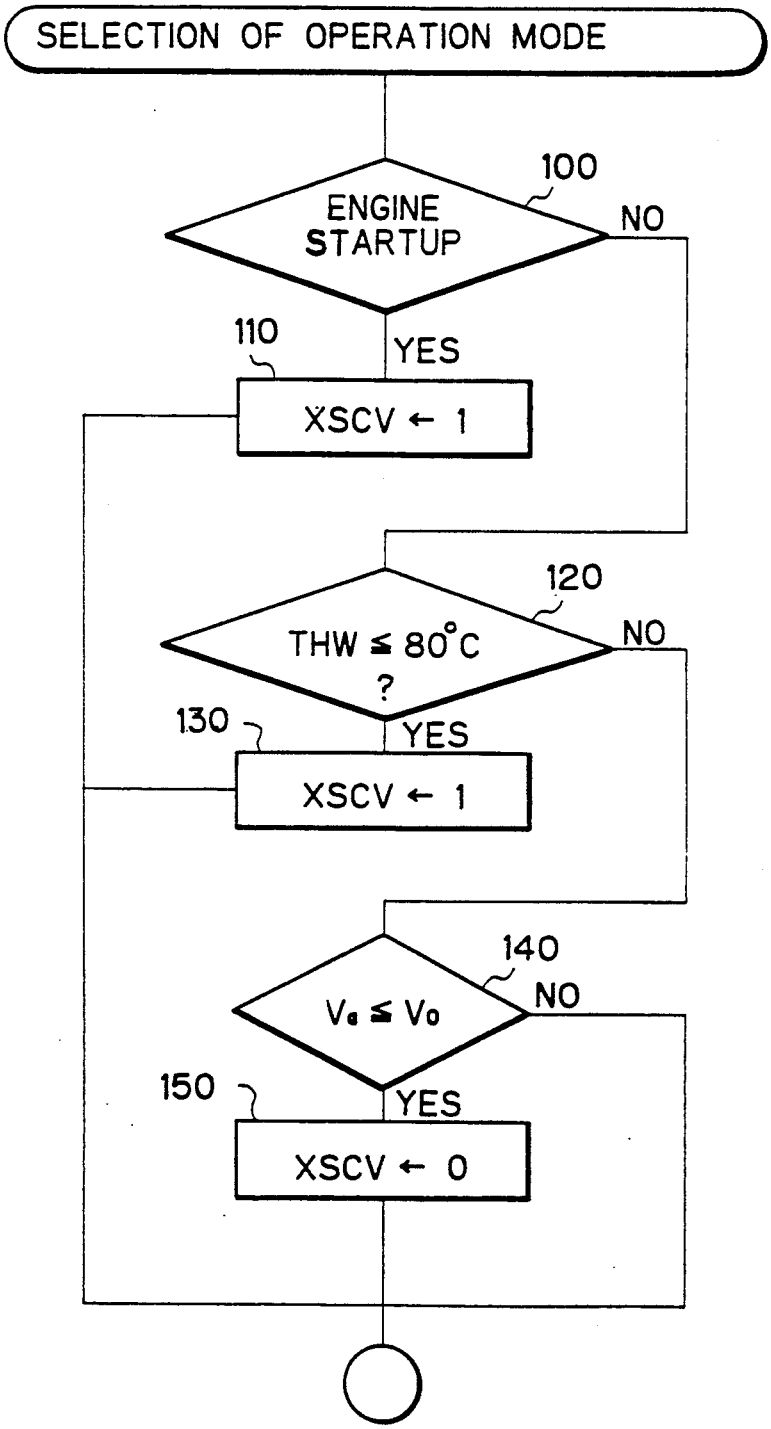
FIG. 2 is a flow chart of the selecting of the operation mode of the engine.

FIG. 2 illustrates the routine for selecting the operation mode of the engine, i.e., the air-fuel ratio of the air-fuel mixture supplied to the engine. This routine is processed by the electronic control unit 50 as a part of the main routine for controlling the engine.

Referring to FIG. 2, in step 100 it is determined whether the engine is being started. It is determined that the engine is being started when a startup signal is transmitted from the starter switch 80 and the engine speed is lower than a predetermined value (for example, 400 rpm). If the engine is being started, the routine proceeds to step 110, in which a flag XSCV is set. The flag XSCV represents the operation mode of the engine, and when the flag XSCV is set, the engine is switched to operate on a rich air-fuel mixture.

If it is determined that the engine was already started, i.e., if the engine speed is higher than the predetermined value, in step 120 it is determined whether the cooling water temperature THW is lower than the predetermined value (for example, 80° C.). The cooling water temperature is calculated from the output of the coolant temperature sensor 84.

Figure 3:
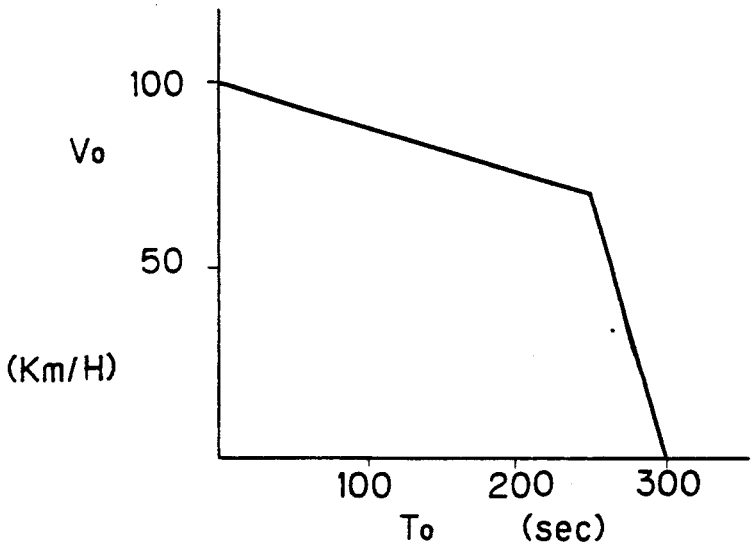
FIG. 3 is a diagram illustrating the relationship between the vehicle speed setting $V_0$ and the time after engine start up.

If the temperature THW is lower than or equal to the predetermined value, the flag XSCV is set in step 130, and if the temperature THW is higher than the predetermined value, the routine proceed to step 140. In step 140, it is determined whether the vehicle speed Va detected by the speed sensor 82 is lower than a value $V_0$. The value $V_0$ is determined as a function of the time $T_0$ after the completion of the startup of the engine. The time $T_0$ is measured by counting the clock pulses of the clock 54*a*. FIG. 3 shows a typical relationship of the value $V_0$ and the time $T_0$. In this embodiment, the relationship of $V_0$ and $T_0$ in FIG. 3 is stored in the ROM 52 in the form of a numeric table. The speed $V_0$ is determined from the table by the CPU 54.

If the vehicle speed Va is higher than or equal to $V_0$, the flag XSCV is reset in step 150, and when the flag XSCV is reset, the engine is switched to operate on a lean air-fuel mixture. If the vehicle speed Va is less than $V_0$, the routine is ended without changing the setting of the flag XSCV.

As shown in FIG. 2, this routine always selects the rich mixture operation mode during engine startup, and does not switch to the lean mixture operation mode unless the vehicle speed Va becomes higher than or equal to $V_0$, even if the cooling water temperature is higher than the predetermined value. As shown in FIG. 3, value $V_0$ is lowered at the time $T_0$, and becomes zero after a predetermined time has elapsed (for example, 300 secs). Therefore, after this predetermined time has elapsed and the cooling water temperature is higher than the predetermined value, the operation mode is automatically switched to a lean mixture operation, regardless of the vehicle speed Va.

In this embodiment, $V_0$ is considered to be a parameter related to the wall temperature of the combustion chamber of the engine. It is considered that the wall temperature of the combustion chamber is a function of the time after startup and an accumulated value of engine operation load after startup. The vehicle speed can be conveniently used as a parameter indicating the accumulated value of the engine operation load, as it represents the total work done by the engine for accelerating the vehicle from a standstill to a certain speed.

There are other parameters which relate to the accumulated engine operation load; for example, parameters such as accumulated values of the engine revolutions, of the intake manifold pressure, or the total amount of fuel injected can be used, but the engine revolutions and the intake manifold pressure are widely varied during the engine operation, and due to these variations, the accumulated values of these parameters include relatively large errors. Also, the total amount of the injected fuel is largely influenced by the cooling water temperature, and a complicated correction process is required for the calculation. The vehicle speed can be conveniently and reliably used because these problems do not arise when estimating the wall temperature of the combustion chamber thereby.

In this embodiment, as understood from step 140 of FIG. 2, once the vehicle speed $V_0$ exceeds the value Va and the operation mode is switched to the lean mixture mode, a switching of the operation mode (i.e., from the lean mixture mode to the rich mixture mode) does not occur even if the vehicle speed Va becomes lower than the value $V_0$.

Figure 4:
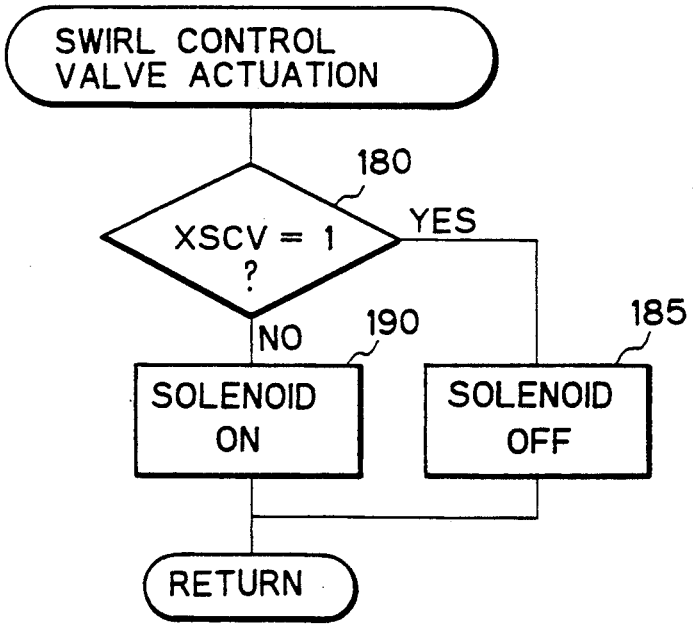
FIG. 4 is a flow chart of the routine for actuating the swirl control valve in accordance with the selected operation mode.

FIG. 4 illustrates the routine for switching the position of the swirl control valve according to the selected operation mode. This routine is processed by the electronic control unit 50 by sequential interruptions at predetermined intervals.

Referring to FIG. 4, in step 180 it is determined whether the flag XSCV is set. The flag XSCV represents the selected operation mode and is set or reset by the routine in FIG. 2.

When the flag XSCV is set in step 180, then in step 185 the solenoid of the three way valve 44 is de-energized. As explained above, when the solenoid is de-energized, the pressure port 22*a* of the surge tank 22 is in communication with the upper side of the diaphragm 40 of the actuator 38, via the check valve 42*b*, and therefore, the diaphragm 40 is moved upward against the force exerted by the spring 41. This movement of the diaphragm 40 causes the swirl control valve 32 to move to the closed position, and when the swirl control valve 32 is in the closed position, the negative pressure in the actuator 38 is maintained by the check valve 46, and thus the swirl control valve 32 is held in the closed position even when the pressure in the surge tank 22 becomes higher.

When the flag XSCV is reset, in step 190 the solenoid of the three way valve 44 is de-energized and the upper side of the diaphragm 40 of the actuator 38 is then open to the atmosphere through the filter 48 and the check valve 42*a* of the timing control valve 42. Accordingly, the diaphragm 40 is urged downward by the spring 41 and the swirl control valve 32 is moved to the open position. The opening speed of the swirl control valve 32 is appropriately controlled by the orifice 42*a*, and the closing speed thereof is maintained by the check valve 42*b*.

Figure 5:
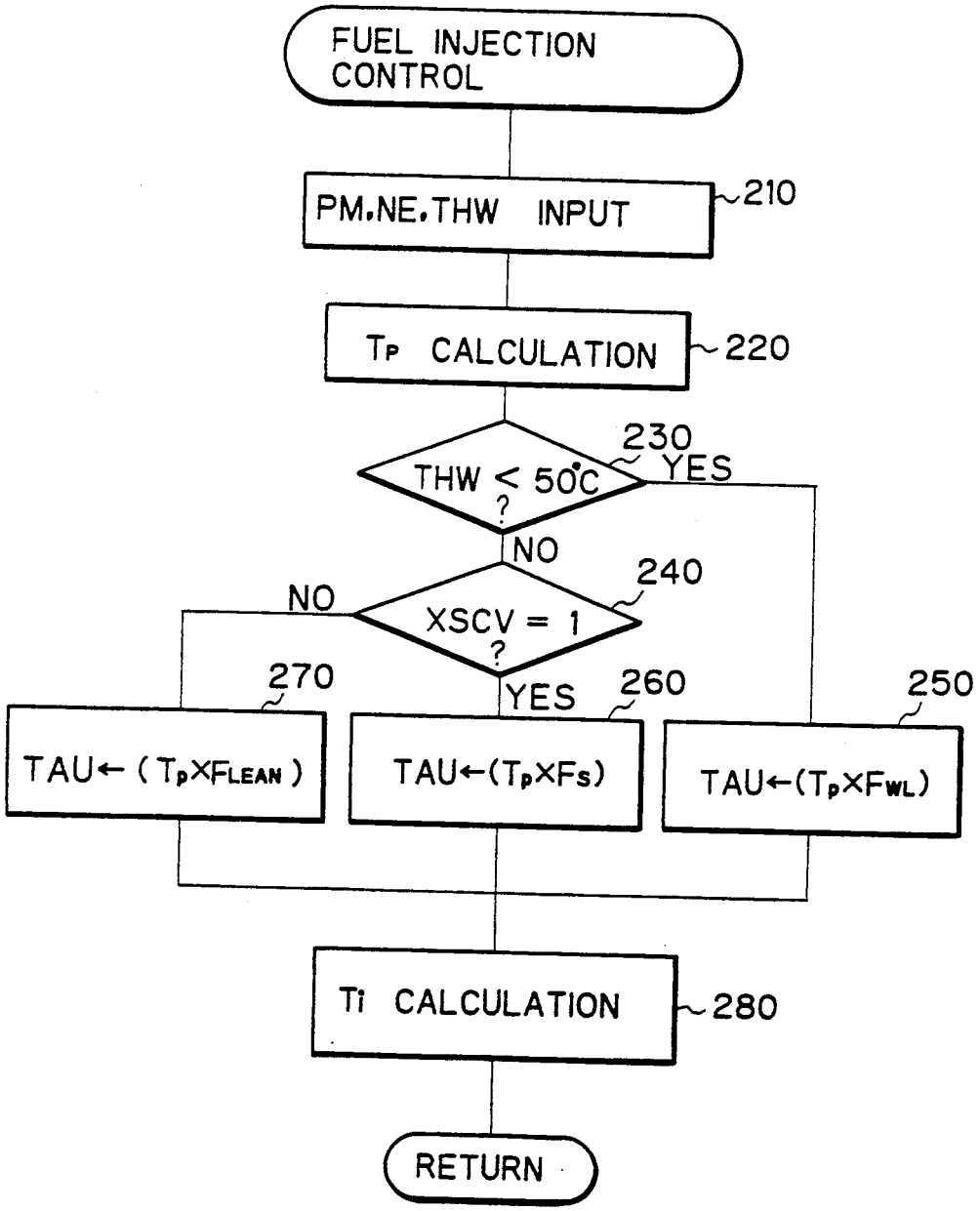
FIG. 5 is a flow chart of the routine for adjusting the air-fuel ratio of the mixture in accordance with the selected operation mode; and, FIG. 6 is a flow chart of the routine for adjusting the ignition timing in accordance with the selected operation mode.

FIG. 5 illustrates the routine for determining the amount of the fuel to be injected, to adjust the air-fuel ratio of the mixture in accordance with the operation mode selected by the routine in FIG. 2. This routine is processed immediately before the fuel is injected, when the crank angle detected by the sensors 74, 76 reaches a predetermined angle.

Referring to FIG. 5, in step 210, the intake air manifold pressure (the pressure in the surge tank 22) PM, the engine speed NE, the cooling water temperature THW are read by the sensors 72, 76, 84, respectively, and in step 220, a standard amount of fuel injection Tp is determined as a function of the manifold pressure PM and the engine speed NE. In this embodiment, the standard amount Tp is stored in the ROM 52 of the electronic control unit 50, in the form of a numeric table. Note that if the standard amount TP is provided, the air-fuel ratio becomes stoichiometric ratio. Then, in step 230, it is determined whether the cooling water temperature THW is lower than a predetermined temperature (for example, 50° C.). If the THW is lower than the predetermined value, in step 250, a corrected amount of fuel injection TAU is determined by multiplying a correction factor FWL with the standard amount of fuel injection Tp. The correction factor FWL is determined as a function of the cooling water temperature, which is stored in the ROM 52 in the form of a numeric table. The purpose of the correction factor FWL is to make the air-fuel ratio of the mixture rich so that a stable combustion is obtained when the cooling water temperature is low. Note that the correction factor is larger than the value "1.0". Then, in step 280, the fuel injection time $T_i$ is calculated on the basis of the determined TAU, and the fuel injector 26 is opened for the time $T_i$ so that the required amount of fuel TAU is injected.

When the cooling water temperature THW is higher than or equal to the predetermined value in step 230, then in step 240 it is determined whether the flag XSCV is set. When the flag XSCV is set, then the corrected amount of fuel injection TAU is decided in step 280 by multiplying a rich mixture correction factor $F_S$ with the standard amount of fuel injection Tp. The rich mixture correction factor $F_S$ is a constant or variable value used to set the corrected amount of fuel injection so that the air-fuel ratio of the mixture becomes lower (richer) than or equal to stoichiometric air-fuel ratio. Note that the correction factor is equal to or larger than the value "1.0". After the TAU is set in step 260, the fuel injection time $T_i$ is set in step 260. If the flag XSCV is reset in step 240, the corrected amount of fuel injection TAU is determined in step 270 by multiplying a lean mixture correction factor $F_{LFAN}$ with the standard amount of fuel injection Tp. The lean mixture correction factor $F_{LEAN}$ is a constant or variable value used to set the corrected amount of fuel injection TAU so that the air-fuel ratio of the mixture becomes higher than the stoichiometric air-fuel ratio. Note that the lean mixture correction factor $F_{LEAN}$ has the value that is smaller than the value "1.0".

Figure 6:
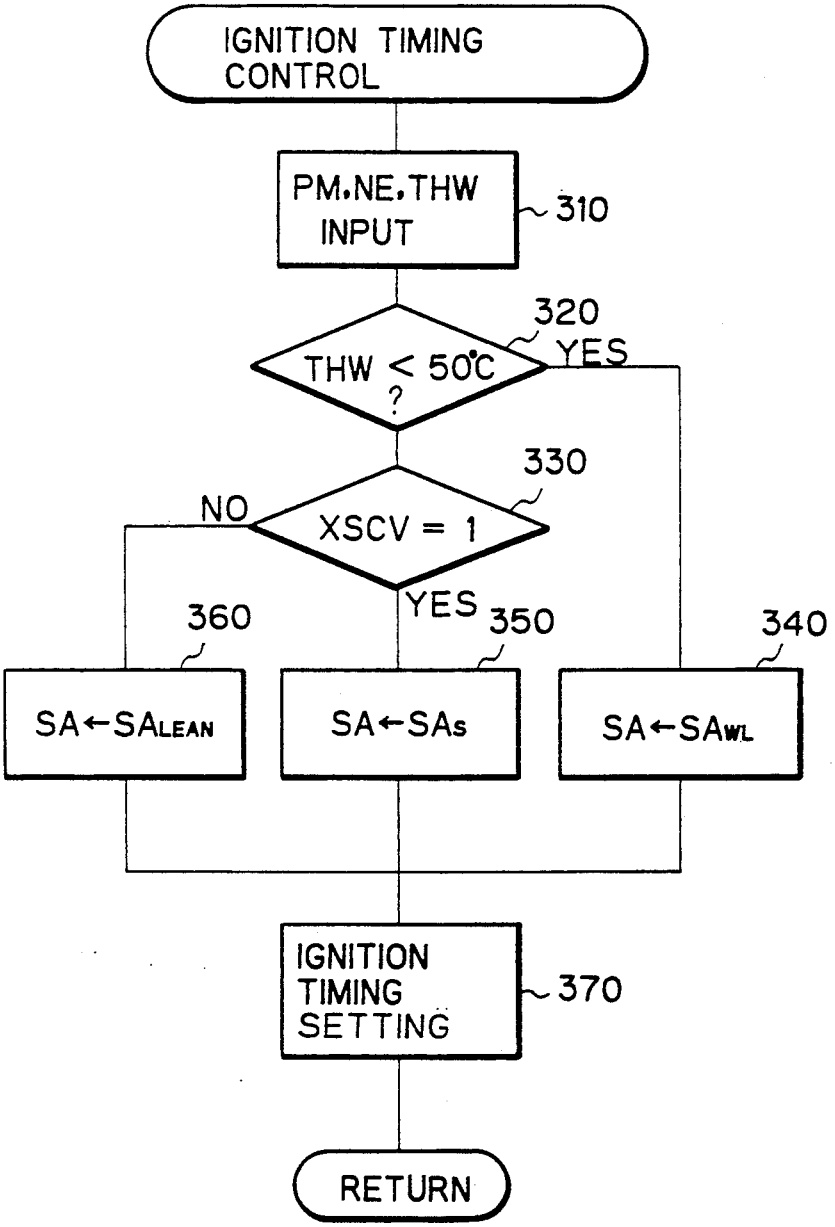

FIG. 6 illustrates the routine for selecting the ignition timing in accordance with the operation mode selected by the routine in FIG. 2. This routine is processed by the electronic control unit 50 as a part of the main routine for controlling the engine.

Referring to FIG. 6, steps 310, 320, 330 correspond to steps 210, 220, 230 in FIG. 5. When the cooling water temperature THW is lower than the predetermined value, a cold condition ignition timing $SA_{WL}$ is selected as an ignition timing setting SA.

$SA_{WL}$ is a function of PM, NE and THW, which is stored in ROM 52 in the form of a numeric table, and provides an ignition timing suitable for the rich mixture established by the correction factor $F_{WL}$ in step 250 of FIG. 5.

Similarly, $SA_S$ (step 350) and $SA_{LEAN}$ (step 360) are selected as the ignition timing setting SA, in accordance with the setting of the flag XSCV.

$SA_S$ and $S_{LEAN}$ are the functions of PM and NE, and provide an ignition timing suitable for the rich mixture established by step 260 and the lean mixture established by step 270 in FIG. 2 respectively. Since the air-fuel ratio of the mixture and the ignition timing, as well as the position of the swirl control valve, are switched in accordance with the operation mode selected by the routine in FIG. 2, a stable combustion can be obtained with both a rich and a lean mixture.

According to the present invention, when the engine is started, the operation mode is not switched to the operation on the lean air-fuel mixture unless it is judged that the wall temperature of the combustion chamber is high enough to support a stable combustion with the lean air-fuel mixture. Therefore, the misfires caused by an inappropriate switching to lean mixture when the engine is restarted at a high cooling water temperature can be prevented, and a stable operation of the engine is assured under all operating conditions.

Although the invention has been described with reference to a specific embodiment chosen for the purpose of illustration, it should be apparent that numerous modifications could be made thereto by those skilled in the art, without departing from the basic concept and scope of the invention.

We claim:

1. An air-fuel ratio control device to ensure stable combustion in the combustion of a vehicle engine comprising:

means for detecting a temperature of the engine coolant;

means for selecting operation modes of the engine, said operation mode selecting means selecting a rich mixture operation mode in which the engine is operated on a rich air-fuel ratio lower than or equal to a stoichiometric ratio when said engine coolant temperature is lower than a predetermined value, and said operation mode selecting means selecting a lean mixture operation mode in which said engine is operated on a lean air-fuel mixture having an air-fuel ratio higher than said stoichiometric ratio when said coolant temperature is higher than said predetermined value;

means for adjusting an air-fuel ratio of an air-fuel mixture in accordance with an operation mode selected by said selecting means;

means for detecting a startup of said engine;

means for detecting a speed of a vehicle driven by said engine; and means for prohibiting a selection of said lean mixture operation mode during a period from a startup of the engine until the speed of the vehicle reaches a predetermined value, whereby stable combustion is ensured by providing a rich air-fuel mixture when the temperature of the wall of the combustion chambers is too low to support stable combustion of lean air-fuel mixture and to provide a lean air-fuel mixture only when the wall temperature is high enough to support stable combustion.

2. An air fuel ratio control device according to claim 1, further comprising means for measuring a time elapsed after the completion of said engine startup, and said predetermined value of the vehicle speed is determined by said time elapsed after the completion of the startup.

3. An air-fuel ratio control device according to claim 2, wherein said predetermined value of the vehicle speed is reduced with an elapse of time from a completion of said startup of the engine.

4. An air-fuel ratio control device according to claim 2, wherein said predetermined value of the vehicle speed becomes zero after a predetermined time has elapsed from the completion of said startup of the engine.

5. An air-fuel ratio control device according to claim 3, wherein said predetermined value of the vehicle speed becomes zero after a predetermined time has elapsed from the completion of said startup of the engine.

6. An air fuel ratio control device according to claim 2, wherein said startup detecting means determines that the engine startup is completed when the engine speed reaches a predetermined value after the engine startup is initiated.

7. An air-fuel ratio control device according to claim 6, wherein said operation mode selecting means selects a rich mixture operation mode during the startup of the engine, regardless of said engine coolant temperature.

8. An air-fuel ratio control device according to claim 2, wherein once the speed of the vehicle has reached said predetermined value, said prohibiting means does not prohibit the selection of the lean mixture mode even if the speed of the vehicle thereafter becomes lower than said predetermined value.

9. An air-fuel ratio control device according to claim 2, wherein said air-fuel ratio setting means includes fuel injectors and a fuel injection control means which controls an amount of fuel needed to obtain an air-fuel ratio in accordance with the operation mode selected by said operation mode selecting means.

10. An air-fuel ratio control device according to claim 9, wherein said air-fuel ratio setting means further includes ignition timing control means which controls a timing of ignition in accordance with the operation mode selected by said operation mode selecting means.

11. An air-fuel ratio control device according to claim 10, wherein said air-fuel ratio setting means further includes means for generating an inlet air swirl within engine cylinders when the lean mixture operation mode is selected by said operation mode selecting means.

12. An air-fuel ratio control device according to claim 11, wherein said means for generating an inlet air swirl includes helical ports and straight ports of the engine cylinders for inlet air, and swirl control valves which close inlet air passages to said straight port when the lean mixture operation mode is selected, so that inlet air to the engine flows into the engine cylinders only through said helical ports.

13. An air-fuel ratio control device to ensure stable combustion in the combustion chambers of a vehicle engine comprising:

means for detecting a value of a parameter relating to the temperature of the wall of the combustion chambers of the engine;

means for setting a predetermined value of said parameter in accordance with the period running from a start of the engine;

means for determining whether said detected value is larger than said predetermined value; and means for providing an air-fuel mixture having an air-fuel ratio larger than stoichiometric when is determined by said determining means that said detected value is smaller than said predetermined value.

14. An air-fuel ratio control device according to claim 13, wherein said detected parameter is a speed of a vehicle driven by said engine.

15. An air-fuel ratio control device according to claim 13, wherein said predetermined value decreases as said time period running from said start of said engine increases.

16. An air-fuel ratio control device according to claim 14, wherein said predetermined value decreases as said time period running from said start of said engine increases.

17. An air-fuel ratio control device for a vehicle engine comprising:

means for determining whether a wall temperature of the combustion chambers of the engine is high enough to enable a stable combustion with a lean air-fuel mixture having an air-fuel ratio higher than stoichiometric;

means for providing said lean air-fuel mixture when it is determined that said wall temperature is high enough to enable a stable combustion with said lean air-fuel mixture; and means for providing an air-fuel mixture having an air-fuel ratio other than said lean air-fuel ratio when it is determined that said wall temperature is not high enough to enable a stable combustion with said lean air-fuel mixture.

18. The device of claim 17, wherein said determining means comprises;

means for detecting a value of a parameter relating to said wall temperature;

means for judging whether or not said wall temperature is higher than a predetermined value based on said parameter.

19. The device of claim 18, wherein said parameter is an accumulated value of an operating load of said engine after a startup of the engine.

20. The device of claim 18, wherein said parameter is a speed of the vehicle driven by the engine.

21. The device of claim 18, wherein:

said parameter is a speed of the vehicle driven by the engine; and said predetermined value varies with a time elapsed after a start of the engine.

22. The device of claim 18, wherein:

said parameter is a speed of the vehicle driven by the engine; and said predetermined value decreases with time from a start of the engine.

23. A method of controlling an air-fuel ratio of an air-fuel mixture supplied to a vehicle engine comprising the steps of:

determining whether or not a wall temperature of the combustion chambers of the engine is high enough to enable a stable combustion with a lean air-fuel mixture having an air-fuel ratio higher than stoichiometric; and providing the engine with said lean air-fuel mixture when it is determined that said wall temperature is high enough to enable a stable combustion with said lean air-fuel mixture; and providing the engine with an air-fuel mixture having an air-fuel ratio other than said lean air-fuel ratio when it is determined that said wall temperature is not high enough to enable a stable combustion with said lean air-fuel mixture.

24. The method of claim 23, wherein said step of determining whether or not the wall temperature of the combustion chambers of the engine is high enough to enable a stable combustion with said lean air-fuel mixture comprises the steps of:

detecting a value of a parameter relating to said wall temperature; and determining from said parameter whether or not said wall temperature is higher than a predetermined value.

25. The method of claim 24, wherein said parameter is an accumulated value of an operating load of the engine after a start of the engine.

26. The method of claim 24, wherein said parameter is a speed of the vehicle driven by the engine.

27. The method of claim 24, wherein said parameter is a speed of the vehicle driven by the engine; and said predetermined value varies with a time elapsed after a start of the engine.

28. The method of claim 24, wherein said parameter is a speed of the vehicle driven by the engine; and said predetermined value decreases with a time from the start of the start of the engine.

* * * * *

UNITED STATES PATENT AND TRADEMARK OFFICE

CERTIFICATE OF CORRECTION

PATENT NO. : 5,092,297

DATED : March 3, 1992

INVENTOR(S) : Keisuke TSUKAMOTO, et al.

It is certified that error appears in the above-identified patent and that said Letters Patent is hereby corrected as shown below:

Column 7, line 16, change "280" to --260--.

Column 7, line 25, change "260" to --280--.

Column 8, line 13, between "combustion" and "of" insert --chambers--.

Column 9, line 48, between "when" and "is" insert --it--.

Signed and Sealed this

Tenth Day of August, 1993

*Attest:*

Michael K. Kirk

MICHAEL K. KIRK

*Attesting Officer*

*Acting Commissioner of Patents and Trademarks*